US007943853B2

(12) United States Patent
Pettersson et al.

(10) Patent No.: US 7,943,853 B2
(45) Date of Patent: May 17, 2011

(54) METHOD FOR MANUFACTURING A POST INSULATOR AND A POST INSULATOR

(75) Inventors: Joakim Pettersson, Piteå (SE); Mattias Lundquist, Piteå (SE)

(73) Assignee: ABB Technology Ltd., Zürich (CH)

( * ) Notice: Subject to any disclaimer, the term of this patent is extended or adjusted under 35 U.S.C. 154(b) by 522 days.

(21) Appl. No.: 12/158,824

(22) PCT Filed: Nov. 28, 2006

(86) PCT No.: PCT/SE2006/050513

§ 371 (c)(1),
(2), (4) Date: Jun. 23, 2008

(87) PCT Pub. No.: WO2007/073322

PCT Pub. Date: Jun. 28, 2007

(65) Prior Publication Data

US 2008/0296045 A1 Dec. 4, 2008

(30) Foreign Application Priority Data

Dec. 23, 2005 (EP) ..... 05112967

(51) Int. Cl.
*H01B 17/00* (2006.01)

(52) U.S. Cl. ..... 174/137 R; 174/178; 174/174; 156/69; 29/557

(58) Field of Classification Search ..... 174/137 R, 174/174, 176, 189, 155; 156/69, 245; 29/887, 29/729; 248/62

See application file for complete search history.

(56) References Cited

U.S. PATENT DOCUMENTS

| | | | | |
|---|---|---|---|---|
| 3,300,570 | A | 1/1967 | Spiece et al. | |
| 3,531,578 | A | 9/1970 | Dey | |
| 5,413,443 | A | 5/1995 | Aghamehdi | |
| 6,215,075 | B1 * | 4/2001 | Pazdirek | 174/178 |
| 7,109,422 | B2 * | 9/2006 | Hiroshi et al. | 174/73.1 |
| 7,728,230 | B2 * | 6/2010 | Ma | 174/137 R |

FOREIGN PATENT DOCUMENTS

| | | | |
|---|---|---|---|
| GB | 545839 | A | 6/1942 |
| WO | WO-03/014496 | A1 | 2/2003 |

OTHER PUBLICATIONS

PCT/ISA/210—International Search Report—Apr. 11, 2007.
PCT/ISA/237—Written Opinion of the International Searching Authority—Apr. 11, 2007.

* cited by examiner

*Primary Examiner* — Dhiru R Patel
(74) *Attorney, Agent, or Firm* — Venable LLP; Eric J. Franklin

(57) ABSTRACT

A method for manufacturing a post insulator. A core is introduced into a tube of an insulating stiff material while leaving a small circumferential space separating the core and inner walls of the tube. Adhesive is introduced under an overpressure into an interior of the tube and is cured while maintaining an overpressure in the interior of the tube.

22 Claims, 1 Drawing Sheet

METHOD FOR MANUFACTURING A POST INSULATOR AND A POST INSULATOR

CROSS-REFERENCE TO RELATED APPLICATIONS

This application claims priority to European patent application 05112967.4 filed 23 Dec. 2005 and is the national phase under 35 U.S.C. §371 of PCT/SE2006/050513 filed 28 Nov. 2006.

TECHNICAL FIELD OF THE INVENTION AND PRIOR ART

The present invention relates to a method for manufacturing a post insulator.

The invention relates to such post insulators of any size used for separating two electrical potentials, normally a high electrical potential from ground. They may be used as so called station post insulators in switchgears in converter stations of plants for transmitting electric power, such as for separating valves in a converter in a station of a HVDC (High Voltage Direct Current) plant with respect to ground. Another possible use is for carry overhead electrical high voltage cables.

Typical sizes for such a post insulator are lengths, i.e. heights, of 6-8 m and diameters of 25-40 cm, but any other size is possible.

The voltage, i.e. potential difference, in question may for instance be 800 kV, although quite different voltages are possible. The voltage may be an alternating voltage or a direct voltage.

The invention relates to such post insulators comprising a tube of an insulating stiff material, which is filled by a core of an insulating material, such as foamed plastic. The tube may have another cross-section then circular, such as square, although a circular cross-section is most frequent. The tube may also have a varying cross-section, such as being conical. The invention is especially directed to so called composite insulators, i.e. which have a tube of a composite material.

It is in a post insulator of this type important that no shortcircuits between electrical potentials separated thereby occur, and this is the reason why the inner volume of the tube is filled by a core of an insulating material.

US 2004/0251385 A1 shows how a post insulator of this type may be filled with foamed plastic for preventing shortcircuits from appearing.

However, in post insulators of this type already known there is a not negligible risk of occurrence of shortcircuits through the post insulator as a consequence of damp penetrating into the interior of the post. The reason for this is that it is difficult to fill the entire inner volume of the tube by said core and keep the total filling over the time. Furthermore, cracks may also be created in the core. Thus, damp may be introduced into spaces formed between the core and the tube and inside the core and cause a shortcircuit through the post insulator.

SUMMARY OF THE INVENTION

The object of the present invention is to provide a method for manufacturing a post insulator of the type described above as well as a post insulator reducing the risks of shortcircuits.

This object is according to the invention obtained by providing a method for manufacturing a post insulator, which comprises the steps:

introducing a core of an insulating material into a tube of an insulating stiff material so as to occupy substantially the entire inner volume of the tube while leaving a small circumferential space separating the core and the inner walls of the tube, closing the tube at the two ends thereof, introducing an adhesive into the tube through a first opening in one of said ends while establishing a second opening at the opposite end of the tube for allowing air to escape from the interior of the tube as said adhesive is introduced, closing said second opening when no more air is coming out thereof, continue the introduction of adhesive into the tube under overpressure until the pressure to be applied for introducing more adhesive into the tube exceeds a predetermined level, closing said first opening, and curing the adhesive while maintaining an overpressure in the interior of the tube.

By deliberately producing the space separating the core and the inner walls of the tube and filling this space with an adhesive while creating an overpressure inside the tube it is ensured that the inner volume of the tube will be completely filled also after curing of the adhesive. A reliable adherence between the core and the tube is ensured thanks to the curing of the adhesive under overpressure. This means that compensation for possible shrinkage of the material is obtained, since compressive stress will remain in the adhesive joint also after the curing. Thus, a homogeneous unit with no risk of introduction of damp is obtained.

According to an embodiment of the invention it is a core of a light, elastically compressible material that is introduced into the tube. This means that the overpressure of the adhesive will result in a compression of the core, so that when the adhesive shrinks during curing the overpressure is maintained by the "backspring"-expansion of the core taking place. The core is for that sake preferably made of foamed plastic, such as hard foam, for instance PVC-foam, or a similar material. "Hard" is here to be interpreted to not exclude elasticity of the material.

According to another embodiment of the invention said core is introduced into a tube of an elastic material and having a thickness making it expanding by the introduction of adhesive thereinto under an overpressure reaching said predetermined level. This means that the tube will be elastically deformed by the introduction of adhesive under overpressure, and when the adhesive shrinks during curing thereof the overpressure is maintained by a "backspring" action of the tube. A suitable, stiff material for the tube is a fibre composite, such as glass fibre epoxy.

According to another embodiment of the invention a thin cord-like member is wound substantially helically around the core with a large pitch angle before the core is introduced into said tube for obtaining said space between the core and the inner walls of the tube by said cord-like member acting as a spacer. This way of winding said cord-like member around the core ensures a circumferential space separating the core and the inner walls of the tube without any risk that any part of the core will bear against an inner wall of the tube and thereby preventing adhesive from being introduced between the core and the tube at that place and connecting them by a adhesive joint. The space is then preferably obtained by said cord-like member being cross-wound around said core, so that once the core is introduced into said tube said cord-like member will bear against the inner walls of the tube by cross-over points thereof.

A suitable material for said cord-like member is glass fibre, but any insulating material having the ability to form a spacer element may be used.

According to another embodiment of the invention said core is introduced into the tube in the form of a plurality of elongated sections each having a cross-section substantially corresponding to the cross-section of the inner volume of the tube. This makes if easier to handle the core, especially when the tube has a considerable length, and it also prevents a possible crack in the core to propagate through the entire core.

According to another embodiment of the invention spacers are introduced between subsequent such core sections for obtaining a distance therebetween to be filled by adhesive. This means that adhesive having an overpressure will also fill these spaces between adjacent core sections binding them to each other, which results in a compressive stress in the adhesive joint connecting adjacent core sections. Spaces in the form of a thin net are preferable introduced between subsequent said core sections. This net may be of the same material as said cord-like member wound around the core.

According to another embodiment of the invention it is a two-component adhesive, such as an epoxy adhesive or a vinyl ester adhesive, that is introduced into the tube. However, other adhesives than two-component ones are conceivable.

According to another embodiment of the invention said predetermined level of the pressure corresponds to an overpressure exceeding 1 bar, preferably exceeding 3 bars. It has been found that an overpressure in this range will result in the advantages mentioned above.

According to another embodiment of the invention said tube is kept inclined with said first opening on a lower level than the second opening at least during the first step of introducing a adhesive into the tube with said second opening open, and the longitudinal extension of the tube is making an angle with a horizontal exceeding 30°, preferably being about 45°. The adhesive has in this way to work against the gravitation when introduced into the tube, so that it will efficiently fill every empty space inside the tube while pressing air out of the tube through said second opening.

The invention also relates to a post insulator, which comprises a tube of an insulating stiff material occupied by a core of an insulating material, which is characterized in that said core occupies substantially the entire volume of the tube while leaving a small circumferential space separating the core and the inner walls of the tube, and said circumferential space is filled by a adhesive applying a pressure on the tube and the core after curing. The advantages of such a post insulator appear from the above discussion of the method according to the invention.

According to an embodiment of the invention said core is made of a plurality of elongated core sections each having a cross section substantially corresponding to the cross-section of the inner volume of the tube and mutually separated by a space filled by adhesive applying a pressure upon adjacent core sections tending to press them apart.

According to yet another embodiment of the invention said core is made of foamed plastic.

Further advantages as well as advantageous features appear from the following description.

BRIEF DESCRIPTION OF THE DRAWINGS

With reference to the appended drawings below follows a specific description of an embodiment of the invention cited as an example.

In the drawings.

DETAILED DESCRIPTION OF EN EMBODIMENT OF THE INVENTION

Figure 1:
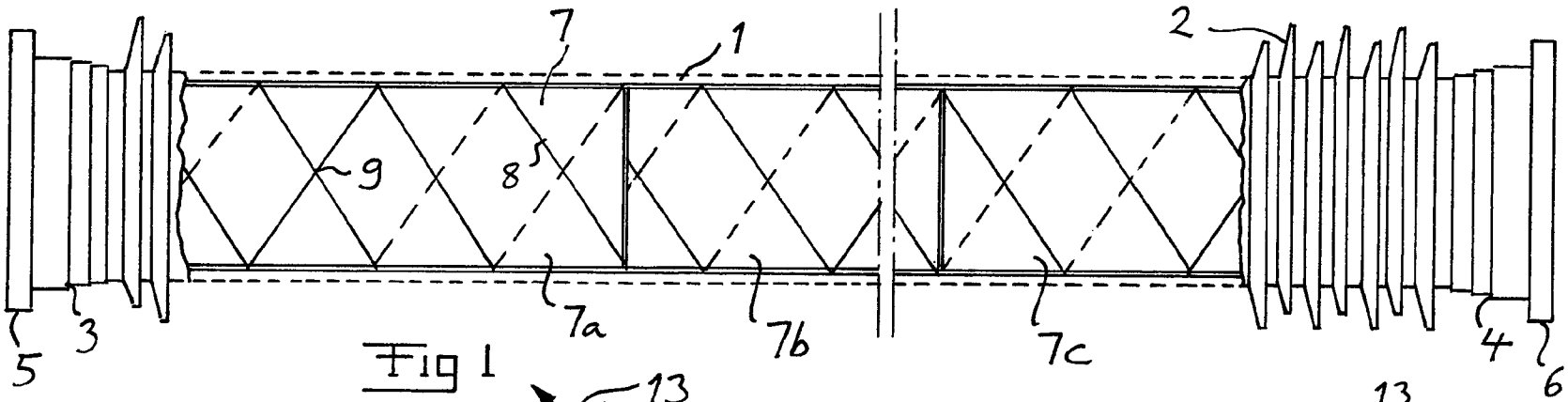
FIG. 1 is a partially sectioned view illustrating a post insulator according to the present invention.
Figure 4:
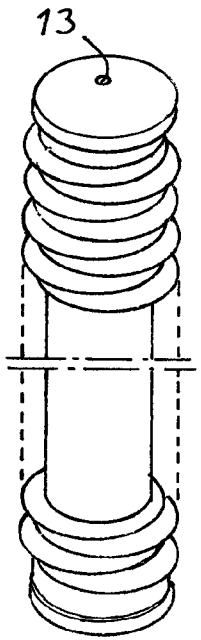
FIG. 4 is a perspective view of a post insulator according to the invention standing on the ground.

FIG. 1 shows schematically a post insulator according to the present invention. This is made of a tube 1 of a fibre composite, such as glass fibre epoxy, which here has a length of approximately six meters and an inner diameter of 31 cm and an outer diameter of 33 cm. The tube 1 has an outer profile of rings 2 of silicon rubber. The tube is at each end thereof provided with flanges 3, 4 of aluminium adhesived to the ends of the tube. Each end of the tube is provided with a flange cover 5, 6 having an outer diameter of about 46 cm and enclosing the inner volume of the tube.

The inner volume of the tube is occupied by a core 7 of an insulating material, such as foamed plastic.

Figure 2:
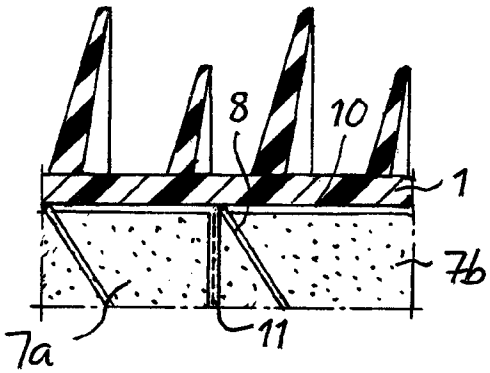
FIG. 2 is an enlarged sectioned view illustrating how adjacent core sections and the inner wall of the tube of the post insulator according to FIG. 1 are arranged.

The further structure of the post insulator will now be described while simultaneously describing the method for manufacturing the post insulator and making reference to all the figures. In this manufacturing process one of the flange covers, such as the flange cover 6, is initially not in place enabling introduction of the core into the inner volume of the tube. The core is made of a number of sections 7*a*, 7*b*, 7*c* having each a length of approximately 1 m. These sections have a cross-section with a diameter slightly smaller than the inner diameter of the tube, such as having a diameter being 2 mm less than the inner diameter of the tube. A thin cord-like member 8 of for example glass fibre is wound substantially helically around each core section before introducing the core section into the tube. This is done with a large pitch angle resulting in a pitch of for example 20 cm. The cord-like member may then be cross-wound around the core, so that once the core is introduced into the tube the cord-like member will bear against the inner walls of the tube by cross-over points 9 thereof. Thus, the cord-like member 8 forms a spacer ensuring that a small circumferential space will separate the core and the inner walls 10 of the tube. A further spacer 11 in the form of a thin net is applied on the end of each core section for obtaining a space between subsequent said core sections as shown in FIG. 2.

Figure 3:
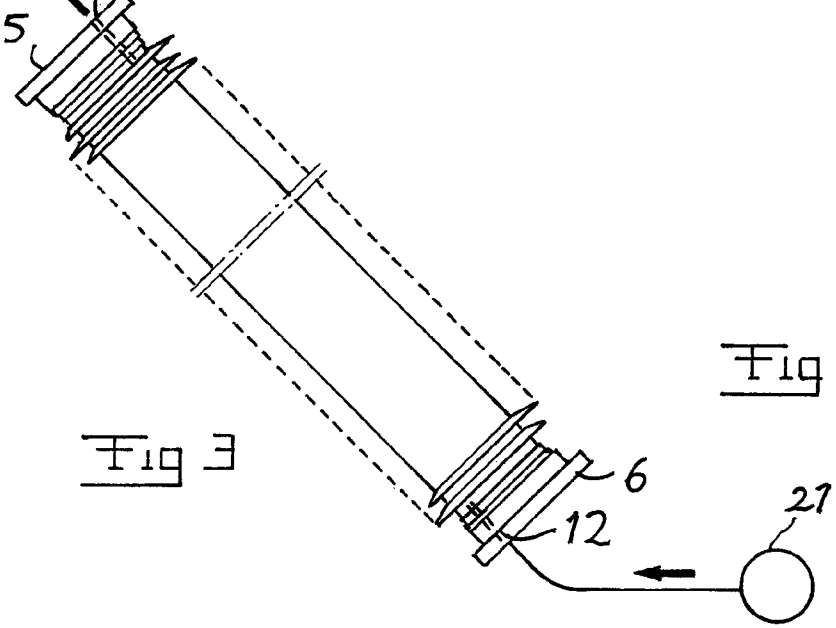
FIG. 3 is a schematic view illustrating a step of the method for manufacturing the post insulator according to the present invention.

When the core sections are in place the flange cover 6 is attached to the flange 4 by bolts and a device 21 for feeding adhesive into the interior of the tube is connected to a first opening 12 in said flange cover. The tube is then inclined with respect to a horizontal while making an angle therewith of approximately 45°. The flange cover 5 has a second opening 13 to the interior of the tube. Adhesive, such as a two-component adhesive, is now introduced into the tube through said first opening 12 while allowing air to escape from the interior of the tube through said second opening 13 on a higher level as said adhesive is introduced. It is shown in FIG. 3 how the two openings are eccentrically arranged in the respective flange cover, so that in the position according to FIG. 3 the first opening 12 is arranged close to the lowest point of the flange cover 6, while the second opening 13 is located close to the highest point of the flange cover 5.

Air present in the spaces between the core sections and the tube wall as well as between core sections will in this way be pressed out of the tube through the second opening 13 when these spaces are filled with adhesive. The second opening will then be closed when no more air, but only adhesive is coming out of this opening.

The introduction of adhesive into the tube is then continued under overpressure until the pressure to be applied for introducing more adhesive into the tube exceeds a predetermined level, which may correspond to an overpressure of 3.5 bars. The connection between the device 21 and the first opening 12 is then removed and this first opening 12 closed by screwing a plug into an internal thread of this opening. The adhesive will then cure while maintaining an overpressure in the interior of the tube.

By the introduction of the adhesive into the tube with an overpressure a full compensation for possible shrinkage of the materials of the core and the tube is obtained, since both the core sections and the tube will be elastically deformed by the overpressure. When the adhesive then shrinks during curing thereof the overpressure is maintained by the "spring-back"-expansion taking place by the core sections and the tube. Thus, compressive stresses will result in the adhesive joint, which are favourable for the strength thereof.

Thus, an homogenous unit with an excellent bounding of the materials to each other is obtained.

Furthermore, this method results in a complete encapsulation of the core, so that the material of the core may be selected so that a cost efficient product is obtained.

The invention is of course not in any way restricted to the embodiment described above, but many possibilities to modifications thereof will be apparent to a person with ordinary skill in the art without departing from the basic idea of the invention as defined in the appended claims.

The invention claimed is:

1. A method for manufacturing a post insulator, the method comprising:

winding a thin cord-like member substantially helically around a core of an insulating material with a large pitch angle, introducing the core into a tube of an insulating stiff material so as to occupy substantially an entire inner volume of the tube, the cord-like member acting as a spacer for obtaining said space between the core and the inner walls of the tube leaving a small circumferential space separating the core and inner walls of the tube, closing the tube at two ends thereof, introducing an adhesive into the tube through a first opening in one of said ends while establishing a second opening at an opposite end of the tube for allowing air to escape from an interior of the tube as said adhesive is introduced, closing said second opening when no more air is coming out thereof, continuing the introduction of adhesive into the tube under overpressure until a pressure to be applied for introducing more adhesive into the tube exceeds a predetermined level, closing said first opening, and curing the adhesive while maintaining an overpressure in the interior of the tube.

2. The method according to claim 1, wherein the core comprises a light, elastically compressible material.

3. The method according to claim 2, wherein the core comprises solidified foamed plastic.

4. The method according to claim 3, wherein the solidified foamed plastic comprises hard foam.

5. The method according to claim 4, wherein the hard foam comprises poly vinyl chloride foam.

6. The method according to claim 1, wherein the tube comprises an elastic material having a thickness that makes the tube expand as a result of the introduction of adhesive into the tube under the overpressure reaching said predetermined level.

7. The method according to claim 6, wherein the tube comprises a composite material.

8. The method according to claim 7, wherein the composite material comprises glass fibre epoxy.

9. The method according to claim 1, wherein said cord-like member is cross-wound around said core, so that once the core is introduced into said tube said cord-like member will bear against the inner walls of the tube by cross-over points thereof.

10. The method according to claim 1, wherein said cord-like member comprises glass fiber.

11. The method according to claim 1, wherein said core comprises a plurality of elongated sections each having a cross-section substantially corresponding to a cross-section of the inner volume of the tube, wherein introducing the core into the tube comprises introducing the plurality of elongated sections.

12. The method according to claim 11, further comprising:

introducing spacers between subsequent of said core sections for obtaining a space therebetween to be filled by said adhesive.

13. The method according to claim 12, wherein the spacers comprises a thin net introduced between subsequent said core sections.

14. The method according to claim 1, wherein the adhesive comprises a two-component adhesive.

15. The method according to claim 14, wherein the adhesive comprises an epoxy adhesive or a vinyl ester adhesive.

16. The method according to claim 1, wherein said predetermined level corresponds to the overpressure exceeding 1 bar.

17. The method according to claim 16, wherein the overpressure exceeds 3 bars.

18. The method according to claim 1, wherein said tube is kept inclined with said first opening on a lower level than the second opening at least during an initial introducing the adhesive into the tube with said second opening open, and wherein a longitudinal extension of the tube forms an angle with a horizontal exceeding thirty degrees.

19. The method according to claim 18, wherein the longitudinal extension of the tube makes an angle with a horizontal exceeding about forty-five degrees.

20. A post insulator, comprising:

a tube comprising an insulating stiff material, a core comprising an insulating material, said core occupying substantially an entire volume of the tube, a thin cord-like member is wound with a large pitch angle around the core, said thin cord-like member acting as a spacer leaving a small circumferential space separating the core and inner walls of the tube, and an adhesive filling the circumferential space and applying a pressure on the tube and the core after curing.

21. The post insulator according to claim 20, wherein said core comprises a plurality of elongated core sections each having a cross-section substantially corresponding to a cross-section of an inner volume of the tube and mutually separated by the space filled by the adhesive applying the pressure upon adjacent said core sections tending to press them apart.

22. The post insulator according to claim 20, wherein said core comprises foam plastic.

* * * * *